US008622017B2

(12) United States Patent
Ivanov et al.

(10) Patent No.: US 8,622,017 B2
(45) Date of Patent: Jan. 7, 2014

(54) ELECTROLESS PLATING SYSTEM

(75) Inventors: Igor Ivanov, Danville, CA (US); Robert D. Tas, Aromas, CA (US); Shashank Ravindra Kulkarni, Santa Clara, CA (US); Ron Rulkens, Milpitas, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 13/111,859

(22) Filed: May 19, 2011

(65) Prior Publication Data

US 2011/0214608 A1 Sep. 8, 2011

Related U.S. Application Data

(62) Division of application No. 11/549,644, filed on Oct. 14, 2006, now Pat. No. 7,972,652.

(60) Provisional application No. 60/596,717, filed on Oct. 14, 2005.

(51) Int. Cl.
*B05C 5/02* (2006.01)

(52) U.S. Cl.
USPC ..... 118/300; 118/313; 118/316; 204/227; 204/275.1

(58) Field of Classification Search
USPC ..... 118/300, 313, 316; 427/97.9, 99.5, 437, 427/443.1; 204/227, 275.1; 134/84, 88, 902
See application file for complete search history.

(56) References Cited

U.S. PATENT DOCUMENTS

| | | | | |
|---|---|---|---|---|
| 4,764,401 | A * | 8/1988 | Sirinyan et al. | 427/304 |
| 6,165,912 | A * | 12/2000 | McConnell et al. | 438/758 |
| 6,913,651 | B2 * | 7/2005 | Ivanov et al. | 118/320 |
| 7,368,016 | B2 * | 5/2008 | Katsuoka et al. | 118/326 |
| 2003/0134047 | A1 * | 7/2003 | Dubin et al. | 427/421 |
| 2005/0158478 | A1 * | 7/2005 | Katsuoka et al. | 427/437 |
| 2006/0081461 | A1 * | 4/2006 | Jomen et al. | 204/275.1 |

FOREIGN PATENT DOCUMENTS

WO WO 99/57340 * 11/1999

* cited by examiner

*Primary Examiner* — Laura Edwards
(74) *Attorney, Agent, or Firm* — Martine Penilla Group, LLP

(57) ABSTRACT

An electroless plating system includes a plating solution, and controlling reducing agents in the plating solution for deposition over outlier features smaller than about five hundred nanometers and isolated by about one thousand nanometers.

11 Claims, 3 Drawing Sheets

ELECTROLESS PLATING SYSTEM

CROSS-REFERENCE TO RELATED APPLICATION(S)

This application claims priority as a divisional of U.S. patent application Ser. No. 11/549,644, filed Oct. 14, 2006, now U.S. Pat. No. 7,972,652, which claims the benefit of U.S. Provisional Patent Application No. 60/596,717, filed Oct. 14, 2005. The disclosures of these applications are herein incorporated by reference in their entirety for all purposes.

TECHNICAL FIELD

The present invention relates generally to plating systems, and more particularly to a system for electroless plating.

BACKGROUND ART

Recent improvements in circuitry of ultra-large scale integration (ULSI) on semiconductor substrates indicate that future generations of semiconductor devices will require even smaller multi-level metallization. The multilevel interconnects that lie at the heart of this technology require planarization of interconnect features formed in high aspect ratio apertures, including contacts, vias, lines and other features. Reliable formation of these interconnect features is very important to the success of ULSI and to the continued effort to increase circuit density and quality on individual substrates and die as features continue to decrease in size.

Copper and its alloys have become the metals of choice for sub-micron interconnect technology because copper has a lower resistivity than aluminum, a higher current carrying capacity, and significantly higher electromigration resistance. These characteristics are important for supporting the higher current densities experienced at high levels of integration and increased device speed. Further, copper has a good thermal conductivity and is available in a highly pure state.

Electroplating is one process being used to fill high aspect ratio features on substrates. Electroplating processes typically require a thin, electrically conductive seed layer to be deposited on the substrate. Electroplating is accomplished by applying an electrical current to the seed layer and exposing the substrate to an electrolytic solution containing metal ions that plate over the seed layer.

Electroless deposition is another process used to deposit conductive materials. Although electroless deposition techniques have been widely used to deposit conductive metals over non-conductive printed circuit boards, electroless deposition techniques have not been extensively used for forming interconnects in VLSI and ULSI semiconductors. Electroless deposition involves an auto catalyzed chemical deposition process that does not require an applied current for a plating reaction to occur. Electroless deposition typically involves exposing a substrate to a solution by immersing the substrate in a bath or by spraying the solution over the substrate.

However, copper readily forms copper oxide when exposed to atmospheric conditions or environments outside of processing equipment and requires a passivation layer to prevent metal oxide formation. Metal oxides can result in an increase the resistance of metal layers, become a source of particle problems, and reduce the reliability of the overall circuit.

Additionally, metal oxides may also detrimentally affect subsequent processing. In one example, oxides may interfere with electroless deposition techniques. Electroless deposition techniques require a surface capable of electron transfer for nucleation, i.e., catalyzing, of a conductive material over that surface, and oxidized surfaces, for example on copper seed layers and metal barrier layers, cannot sufficiently participate in electron transfer for effective electroless deposition.

One solution is to deposit a passivation layer or encapsulation layer on the metal layer to prevent metal oxide formation. Cobalt (CO) and cobalt alloys have been observed as suitable materials for passivating copper. Cobalt may also be deposited by electroless deposition techniques on copper. However, copper does not satisfactorily catalyze or initiate deposition of materials from electroless solutions.

Another solution is to initiate deposition from an electroless solution by contacting the copper substrate with a ferrous material that initiates deposition though a galvanic reaction. However, the process requires a continuous conductive surface over the substrate surface that may not be possible with some passivation applications.

Still another solution is to activate the copper surface by depositing a catalytic material on the copper surface. However, deposition of the catalytic material may require multiple steps or use catalytic colloid compounds. Catalytic colloid compounds may adhere to dielectric materials and result in undesired, excessive, and non-selective deposition of the passivation material on the substrate surface. Non-selective deposition of passivation material may lead to surface contamination, unwanted diffusion of conductive materials into dielectric materials, and even device failure from short circuits and other device irregularities.

Thus, a need still remains for an electroless plating system to provide improved stability and small isolated feature deposition. In view of the ever-increasing commercial competitive pressures, along with growing consumer expectations and the diminishing opportunities for meaningful product differentiation in the marketplace, it is critical that answers be found for these problems. Additionally, the need to save costs, improve efficiencies and performance, and meet competitive pressures, adds an even greater urgency to the critical necessity for finding answers to these problems.

Solutions to these problems have been long sought but prior developments have not taught or suggested any solutions and, thus, solutions to these problems have long eluded those skilled in the art.

DISCLOSURE OF THE INVENTION

The present invention provides a plating solution, and controlling reducing agents in the plating solution for deposition over outlier features smaller than about five hundred nanometers and isolated by about one thousand nanometers.

Certain embodiments of the invention have other aspects in addition to or in place of those mentioned above. The aspects will become apparent to those skilled in the art from a reading of the following detailed description when taken with reference to the accompanying drawings.

BEST MODE FOR CARRYING OUT THE INVENTION

Figure 1:
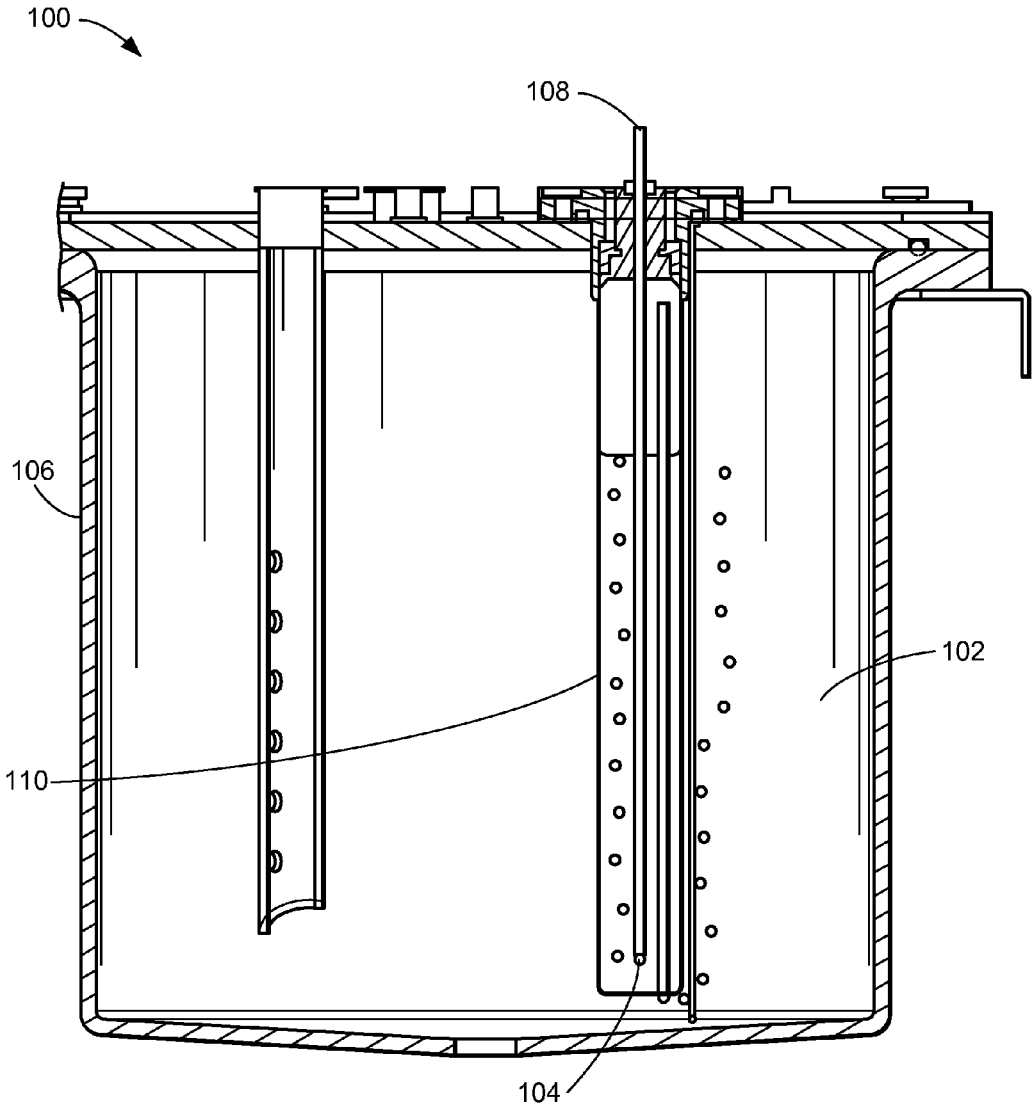
FIG. 1 is a cross-sectional view of an electroless plating system in an embodiment of the present invention in a solution preparation phase.

The following embodiments are described in sufficient detail to enable those skilled in the art to make and use the invention. It is to be understood that other embodiments would be evident based on the present disclosure, and that system, process, or mechanical changes may be made without departing from the scope of the present invention.

In the following description, numerous specific details are given to provide a thorough understanding of the invention. However, it will be apparent that the invention may be practiced without these specific details. In order to avoid obscuring the present invention, some well-known circuits, system configurations, and process steps are not disclosed in detail. Likewise, the drawings showing embodiments of the system are semi-diagrammatic and not to scale and, particularly, some of the dimensions are for the clarity of presentation and are shown greatly exaggerated in the drawing FIGs. Where multiple embodiments are disclosed and described, having some features in common, for clarity and ease of illustration, description, and comprehension thereof, similar and like features one to another will ordinarily be described with like reference numerals.

For expository purposes, the term "horizontal" as used herein is defined as a plane parallel to the plane or surface of the invention, regardless of its orientation. The term "vertical" refers to a direction perpendicular to the horizontal as just defined. Terms, such as "on", "above", "below", "bottom", "top", "side" (as in "sidewall"), "higher", "lower", "upper", "over", and "under", are defined with respect to the horizontal plane.

The term "on" as used herein means and refers to direct contact among elements. The term "processing" as used herein includes stamping, forging, patterning, exposure, development, etching, cleaning, and/or removal of the material or laser trimming as required in forming a described structure. The term "system" as used herein means and refers to the method and to the apparatus of the present invention in accordance with the context in which the term is used.

Referring now to FIG. 1, therein is shown a cross-sectional view of an electroless plating system 100 in an embodiment of the present invention in a solution preparation phase. The electroless plating system 100 includes a plating solution 102, such as an electroless plating solution. An inert gas 104, such as nitrogen, is introduced, such as bubbling, into the electroless plating solution 102. The inert gas 104 can be part of a mixture of inert gases including as an example, nitrogen. The inert gas 104 can be dissolved in the electroless plating solution 102 in a solution tank 106, such as a "Blue 29 CuSeal CDU". The solution tank 106 can include an inlet 108 and optionally a humidifier 110. The inlet 108 provides introduction of the inert gas 104 into the electroless plating system 100.

The electroless plating system 100 can include a multi step process including as an example: surface preparation, initiation, optional rinse, deposition, and post deposition treatments. The electroless plating system 100 provides reduced concentration of reducing agents responsible for solution instability in the electroless plating solution 102, and exposes plating surfaces (not shown) to these reducing agents in a separate initiation step prior to the deposition step. The initiation step, optional rinse step, and deposition step take place in an environment starved of Oxygen, with Oxygen partial pressure less than two thousand pascal (2e3 Pa). Additionally, levels of dissolved Oxygen in the initiation solution, optional rinse solution and deposition solution must be below 4.5 part per million (4.5 ppm) and can be less than one part per million (1 ppm).

The electroless plating solution 102 can require additional de-ionized water (DI water) to maintain predetermined levels in the electroless plating solution 102. The de-ionized water can be added by humidifying the inert gas 104 through the humidifier 110. The inert gas 104 bubbled through the humidifier 110 includes additional de-ionized water as it is introduced into the electroless plating solution 102. De-ionized water can also be added by a replenishment process wherein de-ionized water is introduced to the electroless plating solution 102 without the need for the humidifier 110.

It has been unexpectedly discovered that the electroless plating system 100 provides both plating on an outlier feature (not shown), such as smaller than about five hundred nanometers and isolated by about one thousand nanometers, as well as stability for the electroless plating solution 102.

Figure 2A:
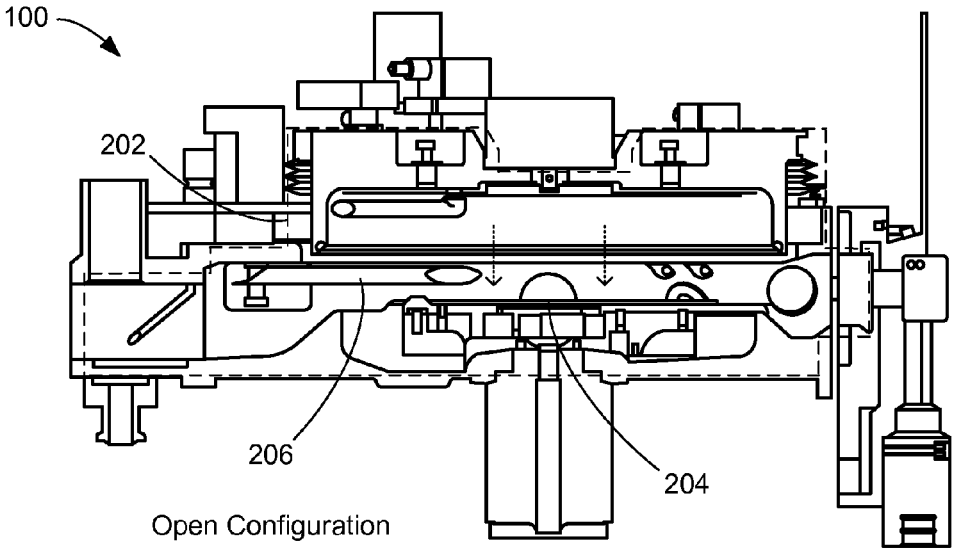
FIG. 2A is a cross-sectional view of the electroless plating system in a surface treatment and initiation phase.

Referring now to FIG. 2A, therein is shown a cross-sectional view of the electroless plating system 100 in a surface treatment and initiation phase. The electroless plating system 100 includes an electroless plating chamber 202. The electroless plating chamber 202 is shown in an open configuration and includes an outer chamber 204 and a lower dispense arm 206. The lower dispense arm 206 is active and the outer chamber 204 is sealed. The outer chamber 204 can be nitrogen purged for surface treatment and initiation of a work piece (not shown). The reducing agents can be introduced to surfaces of the work piece in an initiation process. The electroless plating chamber 202 provides control for the surface treatment and initiation environment of the electroless plating system 100 including controlling concentrations of the reducing agents in the electroless plating solution 102 of FIG. 1.

It has been unexpectedly discovered that maintaining the oxygen starved levels of the electroless plating solution 102 to the predetermined range provides both plating on outlier features as well as stability for the electroless plating solution 102 in the surface treatment phase.

Figure 2B:
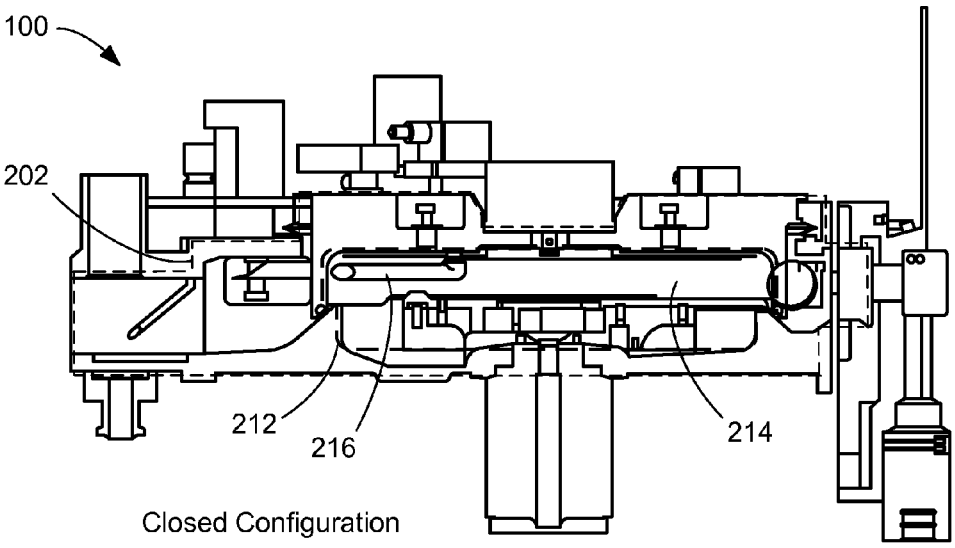
FIG. 2B is a cross-sectional view of the electroless plating system in a deposition phase.

Referring now to FIG. 2B, therein is shown a cross-sectional view of the electroless plating system 100 in a deposition phase. The electroless plating system 100 includes the electroless plating chamber 202. As in FIG. 2A, the outer chamber 204 of FIG. 2A is sealed. The electroless plating chamber 202 is shown at FIG. 2B in a closed configuration and includes an inner chamber 214 and an upper dispense arm 216. The upper dispense arm 216 is active and the inner chamber 214 is sealed. The inner chamber 214 can be nitrogen purged for deposition of the work piece. Reduced concentrations of the reducing agents provide stability in a deposition process. The electroless plating chamber 202 provides control for the deposition environment of the electroless plating system 100 including controlling concentrations of the reducing agents in the electroless plating solution 102 of FIG. 1.

It has been unexpectedly discovered that maintaining the oxygen starved levels of the electroless plating solution 102 to the predetermined range provides both plating on outlier features as well as stability for the electroless plating solution 102 in the deposition phase.

Figure 3:
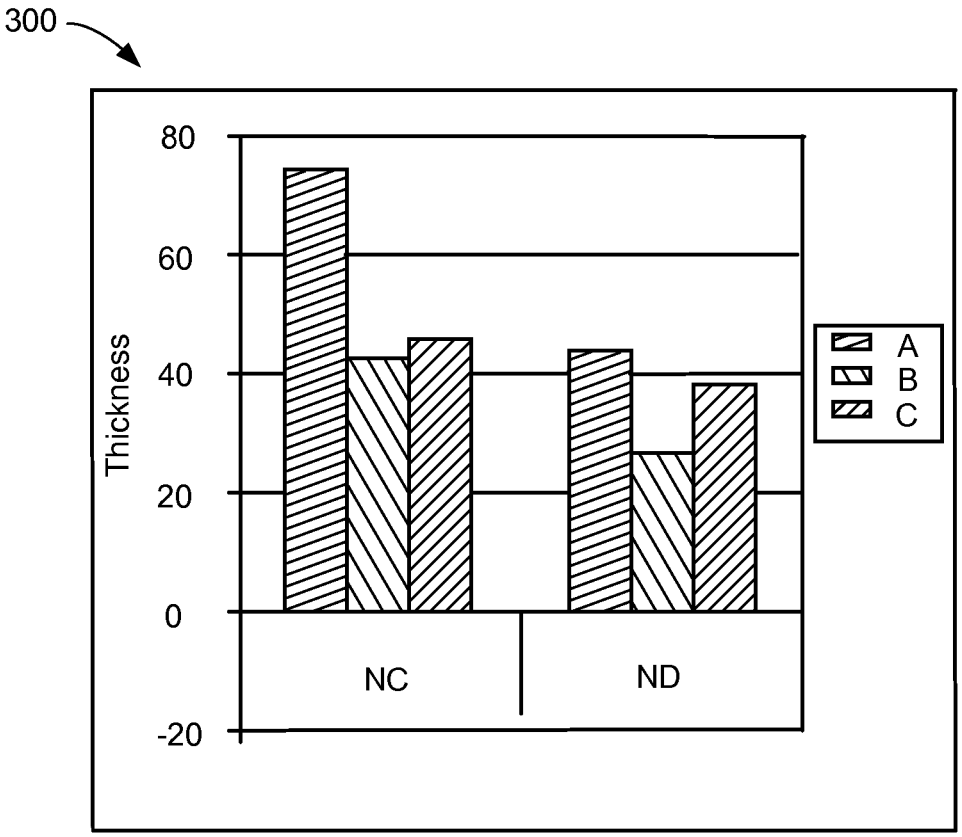
FIG. 3 is a chart of deposition layer thicknesses on the outlier feature of the electroless plating system.

Referring now to FIG. 3, therein is shown a chart of deposition layer thicknesses on the outlier feature of the electroless plating system 100. The electroless plating solution 102 of FIG. 1 with the inert gas 104 of FIG. 1 provides deposition layers (not shown), such as periodic table elements in groups 9-11, with a thickness in a range of about thirty units to about eighty units. The deposition layers are plated to the outlier features while maintaining stability of the electroless plating solution 102, such as reducing concentrations of the reducing agents responsible for instability.

It has been unexpectedly discovered that the electroless plating system 100 of FIG. 1 with the inert gas 104 and the oxygen starved levels in the electroless plating solution 102 provides a predetermined thickness of the deposition layer on the outlier feature, such as small isolated features.

Figure 4:
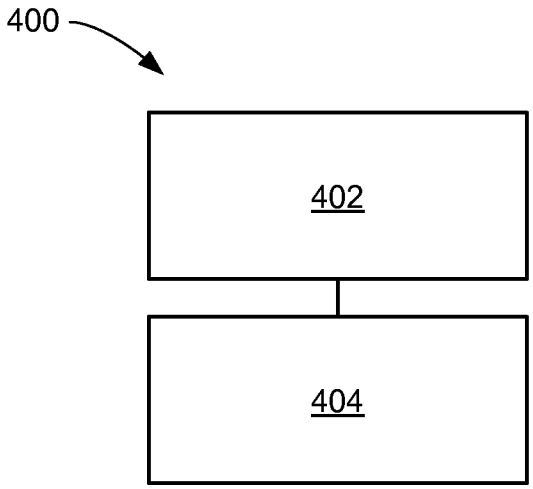
FIG. 4 is a flow chart of an electroless plating system for manufacturing the electroless plating system in an embodiment of the present invention.

Referring now to FIG. 4, therein is shown a flow chart of an electroless plating system 400 for manufacturing the electroless plating system 100 in an embodiment of the present invention. The system 400 includes providing a plating solution in a block 402; and controlling reducing agents in the plating solution for deposition over outlier features smaller than about five hundred nanometers and isolated by about one thousand nanometers in a block 404.

In greater detail, a system to provide the method and apparatus of the electroless plating system 100, in an embodiment of the present invention, is performed as follows:

1. Providing an electroless plating solution.
2. Controlling reducing agents in the electroless plating solution for semiconductor plating.
3. Plating a deposition layer over an outlier feature smaller than about five hundred nanometers and isolated by about one thousand nanometers of a semiconductor.

It has been discovered that the present invention thus has numerous aspects.

A principle aspect that has been unexpectedly discovered is the inert gas in the electroless plating solution. The inert gas bubbled into the electroless plating solution can also be used in the deposition chamber.

Another aspect is that the present invention is reducing the concentration of reducing agents in the electroless plating solution. The reducing agents are responsible for solution instability in the plating solution.

Yet another important aspect is that the present invention provides the reducing agents in the initiation process prior to the deposition process. The reducing agents in the initiation process enable reducing the concentration of reducing agents in the plating solution.

It has been discovered that the disclosed structure provides the deposition layer on the outlier feature. The outlier feature, such as small isolated features, includes a predetermined thickness of the deposition layer.

It has also been discovered that the disclosed structure provides stability of the deposition solution. The deposition solution, such as a plating or deposition bath, is stabilized, such as with palladium chloride levels.

Another discovery is that that the disclosed structure provides compatibility with humidifying the inert gas with de-ionized water. De-ionized water replenishment can be provided by the humidifier for the inert gas to be introduced.

Yet another discovery is that the disclosed structure provides compatibility with replenishment processes for de-ionized water. De-ionized water can also be replenished in the electroless plating solution by a process that does not require the humidifier.

Yet another discovery is that the disclosed structure provides compatibility with inert gases or inert gas mixtures. The inert gas can be bubbled into the electroless plating solution individually or as a mixture.

Yet another discovery of the disclosed structure is compatibility with high volume plating methods and apparatus. The electroless plating systems provides deposition and plating on outlier feature as well as electroless plating solution or bath stability.

Yet another important aspect of the present invention is that it valuably supports and services the historical trend of reducing costs, simplifying systems, and increasing performance.

These and other valuable aspects of the present invention consequently further the state of the technology to at least the next level.

Thus, it has been discovered that the electroless plating system, method and apparatus, of the present invention furnish important and heretofore unknown and unavailable solutions, capabilities, and functional aspects. The resulting processes and configurations are straightforward, cost-effective, uncomplicated, highly versatile, accurate, sensitive, and effective, and can be implemented by adapting known components for ready, efficient, and economical manufacturing, application, and utilization.

While the invention has been described in conjunction with a specific best mode, it is to be understood that many alternatives, modifications, and variations will be apparent to those skilled in the art in light of the aforegoing description. Accordingly, it is intended to embrace all such alternatives, modifications, and variations, which fall within the scope of the included claims. All matters hithertofore set forth herein or shown in the accompanying drawings are to be interpreted in an illustrative and non-limiting sense.

What is claimed is:

1. An electroless deposition system, comprising:

an initiation solution source configured to supply an initiation solution, the initiation solution containing reducing agents, wherein the initiation solution source is configured to control a concentration of dissolved oxygen in the initiation solution to be below about four and a half parts per million;

a plating solution tank configured to supply a plating solution, the plating solution containing reducing agents at a concentration which stabilizes the plating solution, the plating solution tank configured to control a concentration of dissolved oxygen in the plating solution to be below about four and a half parts per million;

a plating chamber configured to have an open configuration and a closed configuration, the open configuration defining an outer chamber including a lower dispense arm for dispensing the initiation solution onto a work piece during an initiation phase, and the closed configuration defining an inner chamber including an upper dispense arm for dispensing the plating solution onto the work piece during a deposition phase;

the plating chamber having the open and closed configurations provides for deposition over outlier features of the work piece, the outlier features being smaller than about five hundred nanometers and isolated by about one thousand nanometers; and wherein the reducing agents in the initiation solution define a controlled concentration of reducing agents in the plating solution so as to stabilize the plating solution while also depositing over the outlier features;

wherein the outer chamber is configured to be sealed when exposing the plating surface to the initiation solution; and wherein the inner chamber is configured to be sealed when exposing the plating surface to the plating solution.

2. The electroless deposition system of claim 1, wherein the plating solution tank includes an inlet for introducing an inert gas into the plating solution to control the concentration of dissolved oxygen in the plating solution to be below about four and a half parts per million.

3. The electroless deposition system of claim 2, wherein the plating solution tank includes a humidifier for humidifying the inert gas prior to introducing the inert gas into the plating solution.

4. An electroless cobalt deposition system, comprising:

an initiation solution source configured to supply an initiation solution, the initiation solution containing reducing agents, the initiation solution source configured to control a concentration of dissolved oxygen in the initiation solution to be below a first predefined level;

a cobalt plating solution tank configured to supply a cobalt plating solution, the cobalt plating solution containing reducing agents at a concentration which stabilizes the cobalt plating solution, the cobalt plating solution tank configured to control a concentration of dissolved oxygen in the cobalt plating solution to be below a second predefined level and replenish de-ionized water in the cobalt plating solution;

a plating chamber configured to have an open configuration and a closed configuration, the open configuration defining an outer chamber including a lower dispense arm for dispensing the initiation solution onto a work piece during an initiation phase, and the closed configuration defining an inner chamber including an upper dispense arm for dispensing the cobalt plating solution onto the work piece during the deposition phase;

the plating chamber having the open and closed configurations provides for plating of a cobalt deposition layer over an outlier feature of the work piece, the outlier feature being smaller than about five hundred nanometers and isolated by about one thousand nanometers of a semiconductor; and wherein the reducing agents in the initiation solution define a controlled concentration of reducing agents in the cobalt plating solution so as to stabilize the cobalt plating solution while also plating the cobalt deposition layer over the outlier feature;

wherein the outer chamber is configured to be sealed when exposing the plating surface to the initiation solution; and wherein the inner chamber is configured to be sealed when exposing the plating surface to the plating solution.

5. The electroless cobalt deposition system of claim 4, wherein the initiation solution source is configured to control the concentration of dissolved oxygen in the initiation solution to be below about one part per million.

6. The electroless cobalt deposition system of claim 4, wherein the cobalt plating solution tank includes an inlet for bubbling nitrogen into the cobalt plating solution to control the concentration of dissolved oxygen in the cobalt plating solution to be below about one part per million.

7. The electroless cobalt deposition system of claim 6, wherein the cobalt plating solution tank includes a humidifier for humidifying the nitrogen prior to bubbling the nitrogen into the cobalt plating solution.

8. An electroless cobalt deposition system, comprising:

an initiation solution source for supplying an initiation solution, the initiation solution containing reducing agents, the initiation solution source configured to control a concentration of dissolved oxygen in the initiation solution to be below about four and a half parts per million;

a cobalt plating solution tank for supplying a cobalt plating solution, the cobalt plating solution containing reducing agents at a concentration which stabilizes the cobalt plating solution, the cobalt plating solution tank configured to control a concentration of dissolved oxygen in the cobalt plating solution to be below about four and a half parts per million and replenish de-ionized water in the cobalt plating solution;

a plating chamber configured to have an open configuration and a closed configuration, the open configuration defining an outer chamber including a lower dispense arm for dispensing the initiation solution onto a work piece during an initiation phase, and the closed configuration defining an inner chamber including an upper dispense arm for dispensing the plating solution onto the work piece during a deposition phase;

the plating chamber having the open and closed configurations provides for plating of a cobalt deposition layer over an outlier feature of the work piece, the outlier feature being smaller than about five hundred nanometers and isolated by about one thousand nanometers of a semiconductor; and wherein the reducing agents in the initiation solution define a controlled concentration of reducing agents in the cobalt plating solution so as to stabilize the cobalt plating solution while also plating the cobalt deposition layer over the outlier feature.

9. The electroless cobalt deposition system of claim 8, wherein the cobalt plating solution tank includes an inlet for introducing an inert gas into the cobalt plating solution.

10. The electroless cobalt deposition system of claim 9, wherein the inert gas is nitrogen.

11. The electroless cobalt deposition system of claim 8, wherein the outer chamber is configured to be sealed when exposing the plating surface to the initiation solution; and wherein the inner chamber is configured to be sealed when exposing the plating surface to the cobalt plating solution.

* * * * *